US008910374B2

(12) United States Patent
Davi et al.

(10) Patent No.: US 8,910,374 B2
(45) Date of Patent: Dec. 16, 2014

(54) SERVICE APPARATUS FOR TURBOMACHINE

(71) Applicant: General Electric Company, Schenectady, NY (US)

(72) Inventors: Michael Alan Davi, Niskayuna, NY (US); James Robert Hollis, Greenville, SC (US); Sean Cornelius O'Meara, Schenectady, NY (US); Wayne David Sullivan, Wilmington, NC (US)

(73) Assignee: General Electric Company, Schenectady, NY (US)

( * ) Notice: Subject to any disclaimer, the term of this patent is extended or adjusted under 35 U.S.C. 154(b) by 134 days.

(21) Appl. No.: 13/645,068

(22) Filed: Oct. 4, 2012

(65) Prior Publication Data

US 2014/0096354 A1 Apr. 10, 2014

(51) Int. Cl.
*B66C 17/06* (2006.01)

(52) U.S. Cl.
USPC ..... 29/705; 29/564.1; 212/323; 212/327

(58) Field of Classification Search
CPC ..... B66C 9/10; B66C 9/16; B66C 11/06; B66C 17/00; B66C 19/00; B66C 19/02; B66C 19/005; F01D 25/28; F01D 25/285; F02C 7/32
USPC ..... 29/564, 564.1, 700, 705, 709; 212/71, 212/291, 315, 316, 323, 324, 326, 327; 269/61, 296, 71; 294/119.1
See application file for complete search history.

(56) References Cited

U.S. PATENT DOCUMENTS

| | | | | | |
|---|---|---|---|---|---|
| 718,676 | A | * | 1/1903 | Taylor | 212/312 |
| 1,277,218 | A | | 8/1918 | Kalbach | |
| 2,395,201 | A | | 4/1945 | Smith | |
| 3,061,112 | A | | 10/1962 | Bevard | |
| 3,161,309 | A | * | 12/1964 | Baudhuin et al. | 414/459 |
| 3,389,809 | A | | 6/1968 | Wilson | |
| 3,759,409 | A | * | 9/1973 | Wenzel et al. | 414/460 |
| 4,053,059 | A | | 10/1977 | Hass et al. | |
| 4,289,076 | A | * | 9/1981 | Miller | 105/163.1 |
| 4,645,083 | A | | 2/1987 | Vinciguerra | |
| 4,706,825 | A | | 11/1987 | Johnson | |
| 5,133,465 | A | | 7/1992 | Kalan | |
| 5,350,076 | A | | 9/1994 | Kalan | |
| 5,411,306 | A | | 5/1995 | Campbell et al. | |
| 5,575,607 | A | * | 11/1996 | Grout et al. | 414/589 |
| 5,593,050 | A | | 1/1997 | Lange | |
| 5,653,351 | A | | 8/1997 | Grout et al. | |
| 6,082,562 | A | | 7/2000 | Riikonen | |

(Continued)

FOREIGN PATENT DOCUMENTS

| | | | |
|---|---|---|---|
| JP | 11062621 | A | 3/1995 |
| JP | 2002047947 | A | 2/2002 |

*Primary Examiner* — Alexander P Taousakis
(74) *Attorney, Agent, or Firm* — Hoffman Warnick LLC; Ernest G. Cusick

(57) ABSTRACT

Various embodiments include a service apparatus for a turbomachine. The service apparatus can include: a frame for coupling to an opening in the turbomachine; a bridge member operably coupled to the frame and spanning a width of the frame, the bridge member being substantially movable along a length of the frame; and a crane member operably coupled to the bridge member, the crane member being substantially movable along the width of the frame, wherein the crane member includes at least one attachment device for attaching to an object within the turbomachine.

16 Claims, 3 Drawing Sheets

(56) References Cited

U.S. PATENT DOCUMENTS

| | | | | |
|---|---|---|---|---|
| 6,449,957 | B1 | 9/2002 | Takamatsu et al. | |
| 7,686,175 | B2 | 3/2010 | Waisanen | |
| 7,789,252 | B2 | 9/2010 | Dehlsen et al. | |
| 7,850,026 | B2 | 12/2010 | McKay | |
| 7,926,671 | B2 * | 4/2011 | Wierzba et al. | 212/316 |
| 8,776,360 | B2 * | 7/2014 | Carcy et al. | 29/705 |
| 2002/0023424 | A1 | 2/2002 | Takamatsu et al. | |
| 2007/0033795 | A1 * | 2/2007 | McCaffrey et al. | 29/464 |

* cited by examiner

SERVICE APPARATUS FOR TURBOMACHINE

FIELD OF THE INVENTION

The subject matter disclosed herein relates to power systems. More particularly, the subject matter relates to servicing power systems.

BACKGROUND OF THE INVENTION

Current approaches for performing maintenance on turbomachines (e.g., gas turbine systems) are deficient. In particular, various current approaches employ single-rail cranes located within the turbomachine compartment (or, housing). These single-rail cranes have limited freedom of motion to reach desired components within the turbomachine compartment. Additionally, mounting the single-rail crane within the turbomachine compartment makes it difficult to coordinate maintenance on components internal to the compartment with maintenance on components external to the compartment. For these reasons, among others, conventional approaches for performing maintenance on turbomachines are at least partially ineffective.

BRIEF DESCRIPTION OF THE INVENTION

Various embodiments include a service apparatus for a turbomachine. The service apparatus includes: a frame for coupling proximate an opening in the turbomachine; a bridge member operably coupled to the frame and spanning a width of the frame, the bridge member being substantially movable along a length of the frame; and a crane member operably coupled to the bridge member, the crane member being substantially movable along the width of the frame, wherein the crane member includes at least one attachment device for attaching to an object within the turbomachine.

A first aspect of the invention includes a service apparatus for a turbomachine. The service apparatus can include: a frame for coupling proximate an opening in the turbomachine; a bridge member operably coupled to the frame and spanning a width of the frame, the bridge member being substantially movable along a length of the frame; and a crane member operably coupled to the bridge member, the crane member being substantially movable along the width of the frame, wherein the crane member includes at least one attachment device for attaching to an object within the turbomachine.

A second aspect of the invention includes a service apparatus for a turbomachine, the service apparatus having: a frame for positioning proximate an opening in the turbomachine; a bridge member operably coupled to the frame and spanning a width of the frame, the bridge member being substantially movable along a length of the frame; a crane member operably coupled to the bridge member, the crane member being substantially movable along the width of the frame, wherein the crane member includes at least one attachment device for attaching to an object within the turbomachine; and a mount operably connected with the frame, the mount being sized to couple to a roof guide pin of the turbomachine proximate the opening.

A third aspect of the invention includes a method including: affixing a service apparatus proximate an opening in a turbomachine, the service apparatus including: a frame for coupling to the turbomachine proximate to the opening; a bridge member operably coupled to the frame and spanning a width of the frame, the bridge member being substantially movable along a length of the frame; and a crane member operably coupled to the bridge member, the crane member being substantially movable along the width of the frame, wherein the crane member includes at least one attachment device for attaching to an object within the turbomachine; and attaching the attachment device to the object within the turbomachine for performing maintenance on the object.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

Figure 1:
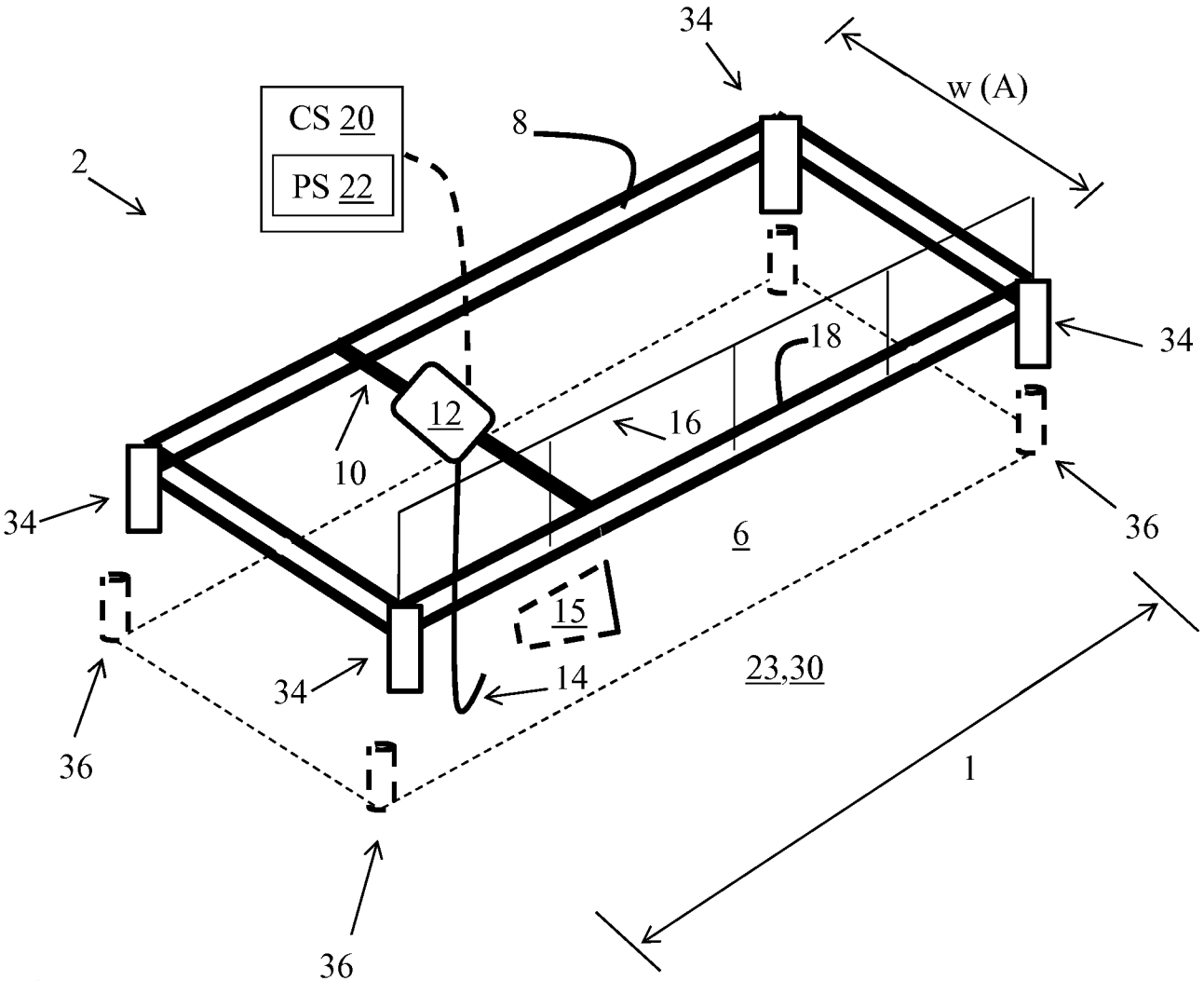
FIG. 1 shows a schematic perspective view of a service apparatus overlying a portion of a turbomachine (in phantom), according to various embodiments of the invention.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As noted, the subject matter disclosed herein relates to power systems, and more particularly, to turbomachines (e.g., gas turbine systems). More particularly, the subject matter relates to servicing power systems such as gas turbine systems.

As described herein, current approaches for performing maintenance on turbomachines (e.g., gas turbine systems) are deficient. In particular, various current approaches employ single-rail cranes located within the turbomachine compartment. These single-rail cranes have limited freedom of motion to reach desired components within the turbomachine compartment. Additionally, mounting the single-rail crane within the turbomachine compartment makes it difficult to coordinate maintenance on components internal to the compartment with maintenance on components external to the compartment.

Additionally, prior approaches which employ permanently installed internal cranes are negatively affected by the environment within the turbomachine compartment during operation of that turbomachine. For example, the high heat load within the turbomachine compartment during operation can damage these internal cranes.

Other conventional cranes which are not permanently installed are installed inside the turbomachine during maintenance operation. However, because these cranes cannot be fully assembled without being installed in the turbomachine, these cranes cannot be tested, e.g., for stability, load concerns, material fatigue, etc.

Even further, an over-arching shortcoming of the conventional cranes is that these devices are typically affixed to the interior of a turbomachine via an external support system, e.g., a single rail system mounted on an interior wall of the turbomachine compartment. Because of this external support system, the conventional cranes are cumbersome to mount and relocate.

In contrast to the conventional approaches, various embodiments of the invention include a service apparatus for a turbomachine which can be mounted proximate an opening in the turbomachine such that it is located above or at the level of the turbomachine compartment. That is, where the turbomachine has had a portion of its compartment removed, the service apparatus can mount (operably attach) to a portion of the compartment remaining in place around the turbomachine. In some cases, a method of servicing the turbomachine is disclosed, where the method can include: removing one or more sections of the turbomachine compartment to form an opening in the turbomachine compartment; affixing the service apparatus to the turbomachine proximate the opening; and performing a service function on a portion of the turbomachine using the service apparatus. The various service apparatuses described herein can be moved with only minimal attachment/detachment to the turbomachine (e.g., via a set of mounts). In some cases, the service apparatus according to embodiments of the invention can attach to already existing roof guide pins in the turbomachine.

In alternative embodiments, the service apparatus can be configured to couple with a surface support structure (e.g. support legs). That is, in some cases, the service apparatus can become a free standing crane using a separate support structure that can be used either on the ground surface proximate to the turbomachine, or in a completely separate (physically separate) maintenance area.

In particular embodiments, service apparatus for a turbomachine is disclosed. The service apparatus can include: a frame for coupling proximate an opening in the turbomachine; a bridge member operably coupled to the frame and spanning a width of the frame, the bridge member being substantially movable along a length of the frame; and a crane member operably coupled to the bridge member, the crane member being substantially movable along the width of the frame, wherein the crane member includes at least one attachment device for attaching to an object within the turbomachine.

Other embodiments of the invention include a service apparatus for a turbomachine, the service apparatus having: a frame for positioning proximate an opening in the turbomachine; a bridge member operably coupled to the frame and spanning a width of the frame, the bridge member being substantially movable along a length of the frame; a crane member operably coupled to the bridge member, the crane member being substantially movable along the width of the frame, wherein the crane member includes at least one attachment device for attaching to an object within the turbomachine; and a mount operably connected with the frame, the mount being sized to couple to a roof guide pin of the turbomachine proximate the opening.

Even further embodiments of the invention include a method including: affixing a service apparatus proximate an opening in a turbomachine, the service apparatus including: a frame for coupling to the turbomachine proximate to the opening; a bridge member operably coupled to the frame and spanning a width of the frame, the bridge member being substantially movable along a length of the frame; and a crane member operably coupled to the bridge member, the crane member being substantially movable along the width of the frame, wherein the crane member includes at least one attachment device for attaching to an object within the turbomachine; and attaching the attachment device to the object within the turbomachine for performing maintenance on the object.

Figure 2:
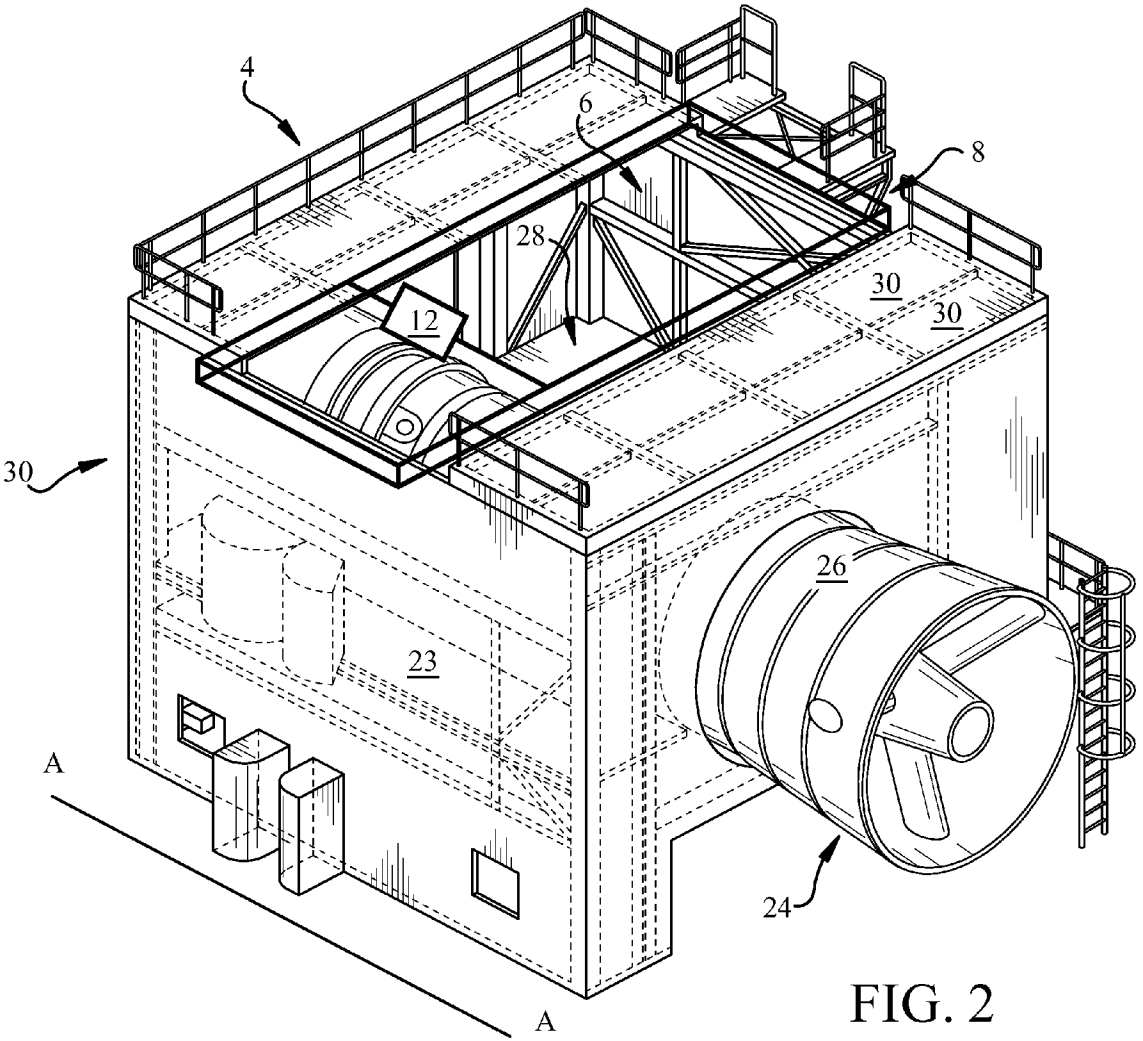
FIG. 2 shows a schematic perspective view of a turbomachine along with a service apparatus according to various embodiments of the invention.

Turning to FIG. 1, a schematic perspective view of a service apparatus 2 is shown according to various embodiments of the invention. As will be described with reference to FIG. 2, the service apparatus 2 can be utilized to service a turbomachine 4 (FIG. 2), and in particular embodiments, the service apparatus 2 is sized and configured to couple proximate to an opening 6 (FIGS. 1 and 2) in the turbomachine 4 (FIG. 2). In some cases, the service apparatus 2 is configured to couple to one or more already existing components on the turbomachine which are adjacent to or near the opening 6. However, in other embodiments, the service apparatus 2 is configured to couple to a separate ground (e.g., ground surface) support structure, e.g., so the service apparatus 2 may be used (e.g., tested) with the separate ground support structure prior to use on the turbomachine 4. In some cases, the service apparatus 2 can be utilized in conjunction with a separate crane in an adjacent or remote (physically separate) maintenance area from the turbomachine 4.

Returning to FIG. 1, the service apparatus 2 according to various embodiments can include a frame 8 for coupling proximate the opening 4 in the turbomachine 2 (FIG. 2) (or, alternatively, coupling with the ground surface support structure either adjacent to the turbomachine or in a remote site location). The service apparatus 2 can also include a bridge member 10 operably coupled to the frame 8 and spanning a width (w) of the frame 8. In some cases, the bridge member 10 is operably coupled to the frame 8 such that the bridge member 10 can slide or otherwise move along a length (l) of the frame 8. In these cases, the bridge member 10 can be movably affixed to the frame 8 by one or more rolling and/or sliding members held within slots in the frame 8. In some cases, the bridge member 10 can be manually adjustable (e.g., along the length (l) of the frame 8), while in other cases, the bridge member 10 can be adjustable by a control system such as an electro-mechanical control system (further described herein). In any case, the bridge member 10 can be substantially movable along the length (l) of the frame 8.

The service apparatus 2 can further include a crane member 12 coupled to the bridge member 10. The crane member 12 can be movable coupled to the bridge member 10 in a similar manner as the bridge member 10 is coupled to the frame 8, or may be otherwise coupled to the bridge member 10 in any conventional manner. The crane member 12 can be coupled to the bridge member 10 such that the crane member 12 is substantially movable along the width (w) of the frame 8.

With reference to both FIG. 1 and FIG. 2, the crane member 12 can include at least one attachment device 14 for attaching to an object 15 (shown in phantom) within the turbomachine 4 (FIG. 2). The frame 8 can have a greater length (l), along a direction perpendicular to the primary axis (A) (FIG. 2) of the turbomachine 4 than its width (w) along the primary axis (A) of the turbomachine 4. That is, in some cases, the frame 8 has a substantially rectangular shape, where its shorter sides run parallel with the primary axis (A) of the turbomachine 4. It is understood that the primary axis (A) of the turbomachine is the axis about which the turbomachine 4 rotates during operation.

FIG. 1 also illustrates that the service apparatus 2 can include a restraining member 16 extending from at least one edge 18 of the frame 8 for restraining an operator (e.g., a human operator) of the crane member 12 proximate the edge 18 of the frame 8. In this case, the restraining member 16 can include one or more rails for inhibiting movement of an operator over the edge 18 of the frame 8 (and consequently, the opening 6 in the turbomachine 4).

The service apparatus 2 can also include a control system 20 operably connected to the crane member 12. The control system (CS) 20 can be configured to modify a position of the crane member 12 along the bridge member 10 (e.g., along the width (w) of the frame 10). In some cases, the crane member 12 is electrically actuatable, and the control system 20 includes a power source (PS) 22 for actuating the crane member 12. In other cases, however, the crane member 12 can be connected to a distinct power source external to the control system 20. As shown in FIG. 1, the control system 20 can be communicatively connected with the crane member 12 to allow an operator to control movement of the crane member 12 and attachment device 14. In some cases, the control system 20 is wirelessly connected to the crane member 12, but in other cases, the control system 20 is hard-wired to the crane member 12.

In some embodiments, the crane member 12 is sized to support a weight of less than approximately 1.5 tons. That is, the crane member 12 can be sized such that it is capable of supporting and transporting objects having a weight up to about 1.5 tons. The crane member 12 could be used in conjunction with external crane systems to transport objects from within the boundary of the compartment 23 of the turbomachine 4 to a location external to the compartment 23 of the turbomachine 4.

Turning to FIG. 2, the turbomachine 4 can include, in various embodiments, a gas turbine 24. In some cases, the gas turbine 24 can include a compressor section 26, a combustion section 28 connected with the compressor section 26, and a turbine section 30 connected with the combustion section 28. In various embodiments, the opening 6 is located over at least one of the compressor section 26, the combustion section 28 or the turbine section 30 (where opening 6 is shown over the combustion section 28).

In various embodiments, the frame 8 spans an axial length (along axis, A) of approximately two roof segments 30 over the at least one of the compressor section 26, combustion section 28 or turbine section 30. Returning to FIG. 1, with continuing reference to FIG. 2, the service apparatus 2 can further include a mount 34 operably connected with the frame 8. In some cases, the service apparatus 2 can four (4) or more mounts 34, where each corner of the frame includes a mount 24 as shown in the example of FIG. 1. The mount 34 can be sized to couple to a roof guide pin 36 (FIG. 1) of the turbomachine 4 proximate the opening 6. The roof guide pin 36 is shown in phantom in FIG. 1 to illustrate its relationship to the opening 6 in the turbomachine 4 compartment 23. That is, the mount 34, in some cases, is sized to couple to a roof guide pin 36 which is otherwise used to retain the removed roof segments 30. More particularly, the mount 34 can be sized such that it slides onto or around one or more roof guide pin(s) 36 of the turbomachine 4. In various embodiments, the mount 34 can be adjustable (in the axial (A) direction, a direction perpendicular to the axial (A) direction, or in any other direction) to accommodate different sized roof guide pins 36.

Figure 3:
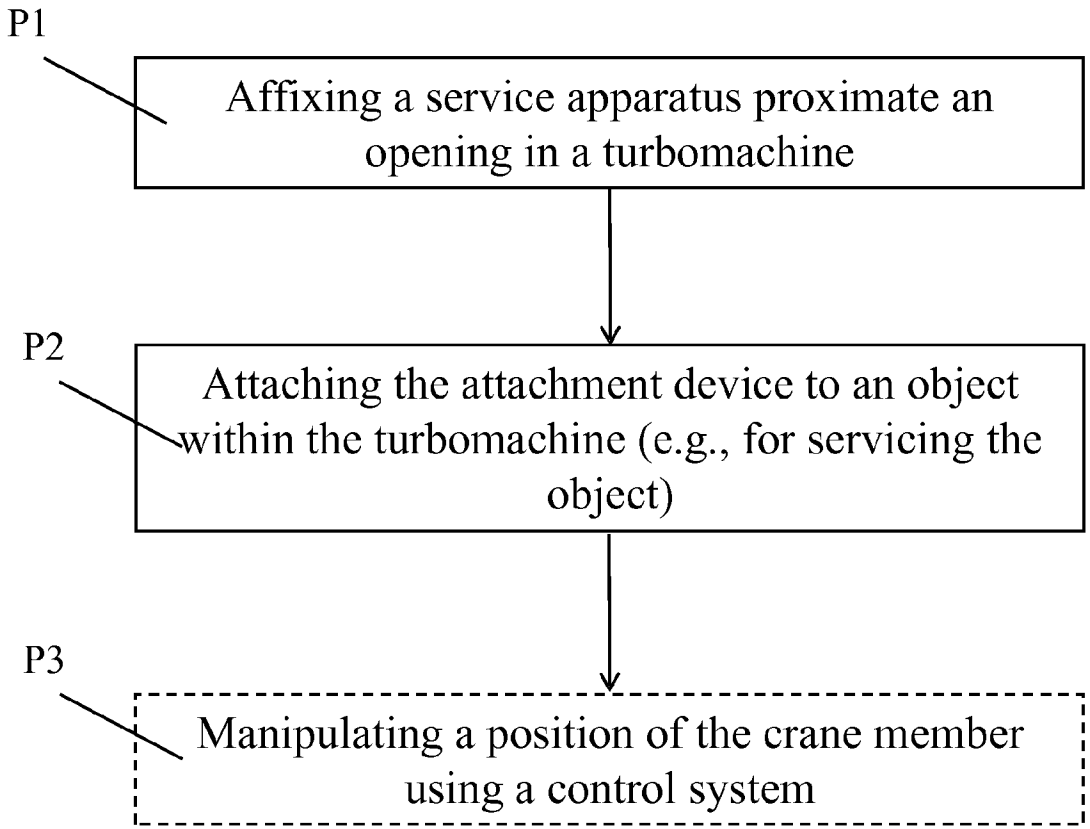
FIG. 3 shows a flow diagram illustrating a process according to various embodiments of the invention.

Various embodiments of the invention relate to a method of servicing a turbomachine (e.g., turbomachine 4). FIG. 3 shows an illustrative flow diagram including processes in a method of servicing a turbomachine. As shown, the method can include:

Process P1: affixing a service apparatus (e.g., service apparatus 2) proximate an opening 6 in a turbomachine 4, the service apparatus 2 including: a frame 8 for coupling to the turbomachine 4 proximate to the opening 6; a bridge member 10 operably coupled to the frame 8 and spanning a width (w) of the frame 8, the bridge member 10 being substantially movable along a length (l) of the frame 8; and a crane member 12 operably coupled to the bridge member 10, the crane member 12 being substantially movable along the width (w) of the frame 8, wherein the crane member 12 includes at least one attachment device 14 for attaching to an object 15 within the turbomachine 4; and Process P2: attaching the attachment device 14 to the object 15 within the turbomachine 4 (e.g., for servicing the object 15); and Process P3 (optionally): manipulating a position of the crane member 12 using a control system (e.g., control system 20).

It is understood that some embodiments of the service apparatus 2 and associated methods of use can provide some benefits when compared with conventional approaches for servicing turbomachines. For example, some embodiments of the service apparatus 2 can be assembled prior to installation on the turbomachine 4, such that the service apparatus 2 can be tested (e.g., for material strength, stability, etc., to determine whether the control system 20 is communicating with the crane member 12 effectively, etc.) before being implemented with the turbomachine 4.

Additionally, some embodiments of the service apparatus 2 include mounts 34 which can be configurable to attach to already existing guide pins 36 on the turbomachine 4. Even further, the adjustability of the mounts 34 allows some embodiments of the service apparatus 2 to couple to distinct types of turbomachine, which allows the service apparatus 2 to be adaptable to different service needs. It is understood that various embodiments of the mounts 34 can be utilized, e.g., mounts 34 each having at least one clip, sleeve, hook and/or retaining lip for engaging with the guide pins 36 on the turbomachine 4. In other embodiments, the mounts 34 can mount to another portion of the turbomachine 4, e.g., by clipping, bolting, hooking, or otherwise engaging a portion of the turbomachine 4 proximate the opening 6.

Even further, some embodiments of the retaining member 16 can allow an operator to stand proximate (near or nearly touching) the edge 18 of the frame 8 while remaining securely away from the opening 6 in the turbomachine 4. It is understood that the above-noted benefits over the conventional service apparatuses are only examples, and that further advantages can be realized by those having skill in the art.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. It is further understood that the terms "front" and "back" are not intended to be limiting and are intended to be interchangeable where appropriate.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A service apparatus for a turbomachine, the service apparatus comprising:

a frame for coupling proximate an opening in the turbomachine;

a bridge member operably coupled to the frame and spanning a width of the frame, the bridge member being substantially movable along a length of the frame;

a crane member operably coupled to the bridge member, the crane member being substantially movable along the width of the frame, wherein the crane member includes at least one attachment device for attaching to an object within the turbomachine; and a restraining member extending from at least one edge of the frame for restraining an operator of the crane member proximate the edge of the frame, where the restraining member inhibits the operator from movement over the edge of the frame.

2. The service apparatus of claim 1, wherein the frame has a greater length along a direction perpendicular to a primary axis of the turbomachine than along the primary axis of the turbomachine.

3. The service apparatus of claim 1, further comprising:

a control system operably connected to the crane member, the control system for modifying a position of the crane member along the bridge member.

4. The service apparatus of claim 3, wherein the crane member is electrically actuatable, and wherein the control system includes a power source for actuating the crane member.

5. The service apparatus of claim 1, wherein the turbomachine includes a gas turbine, the gas turbine having:

a compressor section;

a combustion section connected with the compressor section; and a turbine section connected with the combustion section, wherein the opening is located over at least one of the compressor section, the combustion section or the turbine section.

6. The service apparatus of claim 1, wherein the frame spans an axial length of approximately two roof segments over the at least one of the compressor section, the combustion section or the turbine section.

7. The service apparatus of claim 1, wherein the frame is coupled to a separate ground support structure such that the frame may be tested or used with the separate ground support structure.

8. A service apparatus for a turbomachine, the service apparatus comprising:

a frame for positioning proximate an opening in the turbomachine;

a bridge member operably coupled to the frame and spanning a width of the frame, the bridge member being substantially movable along a length of the frame;

a crane member operably coupled to the bridge member, the crane member being substantially movable along the width of the frame, wherein the crane member includes at least one attachment device for attaching to an object within the turbomachine; and a mount operably connected with the frame, the mount being sized to couple to a roof guide pin of the turbomachine proximate the opening.

9. The service apparatus of claim 8, wherein the frame has a greater length along a direction perpendicular to a primary axis of the turbomachine than along the primary axis of the turbomachine.

10. The service apparatus of claim 8, further comprising:

a restraining member extending from at least one edge of the frame for restraining an operator of the crane member proximate the edge of the frame.

11. The service apparatus of claim 10, wherein the restraining member inhibits the operator from movement over the width of the frame.

12. The service apparatus of claim 8, further comprising:

a control system operably connected to the crane member, the control system for modifying a position of the crane member along the bridge member.

13. The service apparatus of claim 12, wherein the crane member is electrically actuatable, and wherein the control system includes a power source for actuating the crane member.

14. The service apparatus of claim 8, wherein the turbomachine includes a gas turbine, the gas turbine having:

a compressor section;

a combustion section connected with the compressor section; and a turbine section connected with the combustion section, wherein the opening is located over at least one of the compressor section, the combustion section or the turbine section.

15. The service apparatus of claim 8, wherein the frame spans an axial length of approximately two roof segments over the at least one of the compressor section, the combustion section or the turbine section.

16. The service apparatus of claim 8, wherein the crane member is sized to support a weight of less than approximately 1.5 tons.

* * * * *